US008424223B2

(12) United States Patent
Jara et al.

(10) Patent No.: US 8,424,223 B2
(45) Date of Patent: Apr. 23, 2013

(54) HIGH-PERFORMANCE SPORTS SHOE

(75) Inventors: Adam Jara, Clermont-Ferrand (FR); Arnaud Larregain, Thiers (FR); Frédéric Perrin, Beaumont (FR)

(73) Assignees: Compagnie Generale des Etablissements Michelin, Clermont-Ferrand (FR); Michelin Recherche et Technique S.A., Granges-Paccot (CH)

( * ) Notice: Subject to any disclaimer, the term of this patent is extended or adjusted under 35 U.S.C. 154(b) by 667 days.

(21) Appl. No.: 12/526,037

(22) PCT Filed: Feb. 4, 2008

(86) PCT No.: PCT/EP2008/000854

§ 371 (c)(1),
(2), (4) Date: Mar. 21, 2010

(87) PCT Pub. No.: WO2008/095666

PCT Pub. Date: Aug. 14, 2008

(65) Prior Publication Data

US 2010/0170114 A1 Jul. 8, 2010

Related U.S. Application Data

(60) Provisional application No. 60/961,218, filed on Jul. 18, 2007.

(30) Foreign Application Priority Data

Feb. 7, 2007 (FR) ..... 07 00852

(51) Int. Cl.
*A43B 23/28* (2006.01)

(52) U.S. Cl.
USPC ..... 36/59 R; 36/59 C; D2/951

(58) Field of Classification Search ..... 36/59 R, 36/59 C, 114, 25 R; D2/951, 960, 947, 954, D2/956
See application file for complete search history.

(56) References Cited

U.S. PATENT DOCUMENTS 1,528,782 A * 3/1925 Perry ..... 36/59 C
D114,187 S * 4/1939 Leigh ..... D2/960
(Continued)

FOREIGN PATENT DOCUMENTS

EP 0 552 762 7/1993
EP 0 706 767 4/1996
(Continued)

*Primary Examiner* — Marie Patterson
(74) *Attorney, Agent, or Firm* — Cozen O'Connor

(57) ABSTRACT

According to one aspect, the shoe sole (10) comprises at least one main ground engagement section (22) specifically designed to respond to certain modes of solicitation by the foot of the player. Such section is provided with a sculpted pattern having recesses (102) and solid areas (100). The recesses and solid areas are distributed to minimize pressures or stress differences throughout the ground engagement section concerned so as to provide better adherence and lower wear by abrasion in response to such mode of solicitations. Preferably this arrangement is applied to more than one main ground engagement section (22, 24, 42, 44) in the shoe sole, each of which offers a specific response to a particular mode of solicitation by a player in action. According to a preferred embodiment the recesses are made of elongated cells opening (102) in a corresponding solid area through an elongated aperture (101) with rounded ends (108). The application of these principles to the production of a tennis shoe is described.

15 Claims, 2 Drawing Sheets

U.S. PATENT DOCUMENTS

| | | | | | |
|---|---|---|---|---|---|
| 2,155,166 | A | * | 4/1939 | Kraft | 36/59 C |
| 3,593,436 | A | * | 7/1971 | Vietas | 36/32 R |
| 3,988,797 | A | | 11/1976 | Tornero | |
| 4,045,888 | A | * | 9/1977 | Oxenberg | 36/114 |
| 4,134,220 | A | | 1/1979 | Dassler | |
| 4,281,467 | A | * | 8/1981 | Anderie | 36/32 R |
| 4,559,723 | A | * | 12/1985 | Hamy et al. | 36/102 |
| 4,920,663 | A | | 5/1990 | Flemming | |
| 5,203,097 | A | * | 4/1993 | Blair | 36/59 C |
| D335,208 | S | * | 5/1993 | Peterson | D2/956 |
| 5,752,332 | A | * | 5/1998 | Kataoka et al. | 36/134 |
| D405,597 | S | * | 2/1999 | Carlson | D2/960 |
| 6,076,283 | A | * | 6/2000 | Boie | 36/59 C |
| D440,747 | S | * | 4/2001 | Matis et al. | D2/957 |
| 6,354,022 | B2 | * | 3/2002 | Gelsomini | 36/127 |
| D475,182 | S | * | 6/2003 | Matis | D2/956 |
| D484,674 | S | * | 1/2004 | Issler | D2/953 |
| D530,490 | S | * | 10/2006 | Sonnergren | D2/956 |
| D546,532 | S | * | 7/2007 | Matis et al. | D2/953 |
| D570,583 | S | * | 6/2008 | Belley et al. | D2/956 |
| D571,090 | S | * | 6/2008 | Fujita et al. | D2/956 |
| D612,137 | S | * | 3/2010 | Duan | D2/956 |
| D616,639 | S | * | 6/2010 | Larregain et al. | D2/957 |
| 2003/0196353 | A1 | * | 10/2003 | Baek | 36/113 |
| 2005/0257402 | A1 | * | 11/2005 | Kobayashi | 36/59 R |
| 2005/0274044 | A1 | * | 12/2005 | Baek | 36/59 R |
| 2010/0287792 | A1 | * | 11/2010 | Hide | 36/114 |

FOREIGN PATENT DOCUMENTS

| | | | |
|---|---|---|---|
| FR | 2 297 011 | | 8/1976 |
| GB | 2 030 039 | | 4/1980 |
| GB | 2 136 670 | | 9/1984 |
| JP | 2004-216019 | | 8/2004 |
| WO | WO 9938406 | A1 * | 8/1999 |

* cited by examiner

HIGH-PERFORMANCE SPORTS SHOE

RELATED APPLICATIONS

This is a U.S. national stage of application No. PCT/EP2008/000854 filed on Feb. 4, 2008.

This patent application claims the priority of French patent application Ser. No. 07/00852 filed Feb. 7, 2007 and U.S. Provisional Application No. 60/961,218 filed Jul. 18, 2007, the disclosure contents of both of which are hereby incorporated by reference.

FIELD OF THE INVENTION

The present invention relates to sports shoes. In particular, it relates to the behaviour of these shoes in contact with the ground as a function of the stresses exerted by top-level players, whose performance depends to a considerable extent on the quality and variety of the reactions which they can obtain in response to their engagement with the ground. It also relates to the strength and service life of the shoes with respect to wear in the case of intensive and prolonged use, in competitions for example.

BACKGROUND OF THE INVENTION

Some sports and games, for example tennis, but also basketball, volleyball, handball, squash and many others, are played on a relatively small court with a special surface coating which has a major effect on the players' ease of movement at speeds and with accelerations or decelerations which can vary widely (including take-off, braking, sliding, engagement and re-engagement when strokes are played, and sudden changes of direction). Thus sports shoes are generally subject to intense stresses whose nature varies according to the court and the nature of the sport engaged in.

This has led to the development, at least for playing at top level, of shoes specialized for certain sports or types of sports, and sometimes, in the case of tennis for example, even for the nature of the playing surface. It is known that playing tennis on a clay court results in frequent sliding movements by the players which are clearly far greater and more abrasive than on other types of ground. Grass courts, which are clearly less damaging to soles than clay or hard surfaces, require special precautions for adhesion when wet. Many types of hard playing surfaces have also been developed which all have very specific properties of adhesion, abrasion, slip resistance and flexibility of contact.

The technology of sports shoes has thus developed considerably in recent years and manufacturers have diversified their ranges and offer innovative technical solutions for the production of soles.

French patent application 2 297 011 provides an example of a shoe in which, in order to increase wear resistance, the sole has a relatively compact continuous edge around the whole of its periphery, made from a material which is more abrasion-resistant than the central grooved part. Other designers (U.S. Pat. No. 4,134,220 for example) recommend specific materials and/or treatments to promote abrasion-resistance, or, as in U.S. Pat. No. 4,920,663, propose insertions or inclusions in certain sections of the sole for this purpose.

Clearly, as regards adhesion, manufacturers have traditionally made use of sculpted patterns formed by the alternation of solid areas and recesses on the surface of the sole, usually with the aim of creating in this way sharp edges which can increase the ease of adhesion of the sole to the playing surface. Thus, for example, European Patent EP 0 706 767 describes a sole which comprises in its surface a plurality of juxtaposed circular patterns, each pattern being composed of a small circular engagement section surrounded by a channel which is also circular. This results in a sole having a high "edge count" which theoretically provides elements for gripping or adhesion in all directions in its surface. Furthermore, the sole has a hollowed area in its thickness behind each engagement area and the corresponding channel, in such a way that the circular engagement area is suspended and can be pushed elastically towards the inside of the sole under the action of an engagement force perpendicular to the sole, thus providing automatic cleaning to remove the particles which have accumulated in the channel surrounding the area.

Patents EP 0 552 762 and JP 2004 216019 also describe embodiments of soles having straight ribs which are substantially parallel to each other in the direction perpendicular to the longitudinal direction of the shoe. The lateral flanks of these ribs are inclined towards the front of the shoe, in the direction from the ground contact surface towards the inside of the said sole, thus creating an edge which is less sharp than would be the case with a side perpendicular to the ground, and facilitating the forward slip of the shoe to a certain extent. Conversely, the rearward inclination of the rear lateral wall of each rib is substantially less than the forward inclination of its counterpart. The angle at the top of the corresponding edge is therefore more acute and offers greater resistance to the initiation of sliding of the rib in the direction from front to rear (the reverse direction). Certain parts of this sole may also be provided with longitudinal ribs.

It is also known, for example by the International PCT application No. WO99/38406, to provide a sports shoe sole with a rounded inner edge to increase the contact area, when compared with sharper edges, between the sole of the shoe and the ground as the sole tends to rotate during a lateral lunge of the player. Such transverse radius of curvature can be varied somewhat along the edge the keep this area from shrinking too much as one moves forwardly along the edge. Moreover this curved part of the sole in the inner forward portion of the shoe and around the edge thereof is cut with longitudinal channels with a distinct pattern over the tread pattern of the other parts of the sole.

In another embodiment of a sports shoe exemplified by UK patent application No. GB2136670, a plurality of castellated grooves are provided in a frontal area of the sole of a squash shoe, to increase flexibility of the same. In addition serrated edges and strips are provided in different areas under the sole to provide the gripping power where required.

Finally, patent application No. GB 2030039 depicts a sole for shoe for indoor sports with transverse parallel ribs exhibiting alternating sections of identical length but having two different widths. The tips of theses ribs are rounded in the surface of the sole. This provision is apparently designed to allow for some limited or controlled sliding capability. In one embodiment, two areas bordering opposite edges of the sole are provided with a pattern of concentric semi circular ribs exhibiting substantially the same features as depicted above, to allow for some pivoting movements of the sole.

Each of these different arrangements may allow a precise and specific performance objective to be achieved. However if one considers the bundle of performances which must be achieved today they are not adapted to meet the present requirement of top-level users. Indeed there is a requirement nowadays for a better compromise between the required or desirable minimum performance characteristics, which may conflict with each other, together with a sufficient service life with respect to wear, with allowance for the duration of matches or for economic constraints.

SUMMARY OF THE INVENTION

Accordingly, one object of the present invention is to provide a sports shoe whose sole enables a better response to be made to the many specific requirements of players, according to the type of sport engaged in. In particular, it proposes to provide a means of adjusting the compromise between the performance characteristics of long-term wear resistance and adhesion.

Another object of the invention is to propose a sole design which can meet the requirements of tennis players.

According to a further object thereof, the invention aims at providing a sports shoe having an upper for encasing one of the feet (right or left) of a player, and a sole made from a flexible, elastically deformable material, fixed to the upper around its periphery, the said sole having a front end towards the toe of the foot, a rear end at the heel, and a lower face with an alternating arrangement of solid areas, for contact with the ground, and recesses, this face being delimited laterally by an inner lateral edge nearer the other foot (left or right) of the player and an outer lateral edge on the opposite side.

According to one aspect of the invention, such a shoe comprises at least one main ground engagement section, which has an apparent compressibility determined by the distribution of the recesses and solid areas across the surface of said section and which is primarily subjected to a given type of dynamic stresses, over other sections of such sole, in response to a corresponding mode of solicitation by the efforts imparted by the player to the shoe. According to the invention the distribution of these recesses and solid areas over said section is specifically designed to minimize differences between stresses generated across said section in reaction to the afore-mentioned mode of solicitation.

The sole of a sports shoe plays an essential part in the playing performance of most sports. Indeed it is only by using the forms of engagement with the ground available to him that a player can make the movements and strokes characteristic of the particular game or sport which is played.

The constitutive material of the sole partially determines the performance of the shoe. The sole must be flexible enough to bend without requiring too much deforming effort which would tend to tire the foot and elastic return to its normal shape rapidly. Across its thickness, it must be firm enough to transmit the forces and the reactions of the ground with high precision, while providing a suitable degree of comfort for the player. Such soles are mostly made from natural or synthetic elastomers, frequently referred to in this field as "rubber", a term which is used below.

The sole of a sports shoe provided for a top-level player is subjected to static stresses, and also, more importantly, to dynamic stresses of substantial intensity and variety, such as more or less controlled vertical loadings, lateral slides, slips, abrupt braking or take-off, engagement and re-engagement, etc. The precision, reliability and regularity of the reactions of the sole on the player's foot are fundamental conditions for the quality, precision and regularity of his performance.

Naturally, these loadings on the sole also depend on the type of sport played, the playing surface used and the performance level of the player using the sole. Observation has shown that different parts of the sole are loaded differently by the player's foot according to the type of instantaneous performance required by playing situations. Thus, for example, in tennis a player loading the sole to achieve maximum adhesion when re-engaging with the ground after lifting his weight, or when changing direction, or immediately before the impact of the racquet with the ball for a powerful stroke, tends to require most adhesion on the inner lateral side of the front part of the sole, under the head of the metatarsal. Conversely, other situations require the sliding of the foot over the playing surface to reach a remote point as quickly as possible, or to provide rapid but controlled braking.

The applicant's work and experience have also shown that the heating of the principal engagement sections of the sole differs from one section to another and that the degree of wear of the material within each of these sections is a directly increasing function of the maximum operating temperature of each individual location within such section during use. In fact, the wear depends on the intensity of the frictional forces which act on the material at the point of contact and produce heating of the rubber. These forces and the corresponding heating increase with a rise in the pressure between the friction surfaces and the abrasion of the rubber itself increases with the temperature. Evidently, therefore, it would be helpful to decrease the operating temperature of the sole as far as possible, for example by limiting the risks of sliding under a large stress in sections where grip is expected by the player while facilitating intended sliding in other sections where the player requires it.

It is accordingly desirable that, particularly in those sections subject to major ground impacting forces, the engagement pressure do not exceed certain limits and the maximum levels or peaks of dynamic pressure be minimized. In this respect, to avoid excessive pressure peaks in limited areas of those sections of the sole, the invention provides for a distribution of the compression stresses as even as possible over the surface of the loaded section, whereby the differences between the compression stresses generated across such a section of the sole as a result of the actions of the player are minimized to provide both optimal adhesion and better control of wear.

This is achieved in accordance with the particular aspect of the invention set forth above by adjusting or modulating the apparent compressibility of the sole in at least one of the main ground engagement sections thereof in accordance with the expected distribution of wear inducing stresses over said engagement section. As indicated heretofore, this adjustment of the apparent compressibility perpendicular to the surface of the sole can be achieved by the corresponding distribution of recesses and solid areas within the surface of the ground engaging section of the sole considered. More detailed explanations for this will be given hereinafter.

The expected distribution of wear inducing stresses over said engagement section referred to above can be ascertained for example from measurements of temperature. Such measurements typically can provide a map of the rubber temperatures reached at different locations across the ground engaging section of the sole immediately after the shoe has been used by a player for a given period of continuous playing time. One can thus understand that in accordance with the particular aspect of the invention discussed here, the distribution of recesses and solid areas within one or more of the main ground engaging sections of the shoe is designed to even out or minimize differences between the dynamic stresses induced across such section in reaction to specific solicitations of such section by the player in action.

According to a preferred embodiment, the sole comprises at least two main ground engagement sections, each of which is primarily subjected to a different type of dynamic stresses, over other sections of such sole, in response to a corresponding mode of solicitation by the player and the recesses and solid areas are distributed across each of these sections specifically to minimize differences between the stresses generated within such section in reaction to the corresponding player solicitation.

According to one embodiment of the invention, said said sole may at least one main engagement section is intended to be primarily subjected to dynamic compression stresses over more than one section of the sole capable of promoting the grip and lateral adhesion of the sole in response to specific ground impacting pressure solicitations from the player. Such section(s) may be provided in the inner front and for in the inner rear side of the lower face of said sole. It can provide gripping resistance against heavy tangential stresses applied by the player particularly in directions transverse to the length of the shoe.

According to yet another embodiment, at least one of said main engagement section is primarily subjected to tangential friction stresses capable of inducing the sliding of the sole in at least one direction in response to specific solicitations from the player. Here again, the recesses and solid areas of the sole are distributed over the respective sole section so as to minimize differences between the stresses generated within such section in reaction to the corresponding player foot solicitations. Such a section may be provided in the outer front and/or on the outer rear side of the lower face of said sole.

The arrangement of solid areas and recesses can be designed in such a way as to provide straight transitions forming sharp edges in the sculpted pattern which promote the grip of the sole on the playing surface in opposition to forces directed perpendicularly to the orientation of these lines.

According to a complementary aspect, these edges are located in a ground engaging section subjected to ground impacting efforts by the player on the inner side of the shoe. These edges can then be advantageously directed in a generally longitudinal direction to enhance lateral adhesion and grip in opposition to the inward or outward lateral tangential stresses in response to the solicitations of the player.

According to another desirable feature such edges are also located in a ground engagement section subjected to sliding solicitations from the player on the outer side of the sole to somewhat guide the sliding movements of the sole in a preferred direction. It is then beneficial to provide these edges in a direction looking forwardly outwardly in the lower face of the sole for enabling the shoe to slide obliquely in a controlled way in that direction.

In an application of the invention, particularly for shoes for sports played on closed pitches of relatively limited extent, often called "courts", it is advantageous, to provide a shoe sole which has a first principal ground engagement section in which the pattern of solid areas and recesses tends to promote the ground adhesion of the front part of the sole on the inner side, in other words on the side facing the other shoe, in response to ground impacting solicitations from the player and a second principal ground engagement section in the front or forward part of the said sole on the outer side thereof in which the solid areas and recesses have a pattern which tends to facilitate the controlled sliding of the shoe in at least one preferred non longitudinal direction. It is preferred in this case that the percentage area of recesses over solid areas, or indentation ratio, as a result of the distribution of the recesses and solid areas, be greater in the second principal engagement section, which is intended to facilitate the sliding of the shoe under tangential forces, than in the first principal engagement section, which is intended to withstand high dynamic ground impacting efforts from the player which require good grip and lateral adhesion on the ground.

Further embodiments in accordance with the invention may typically include the provision of a) a ground engagement section located under the heel in the vicinity of the rear end of the said sole, capable of promoting braking in the forward direction; b) a ground engagement section in the area immediately adjacent to the front end of the said sole, capable of promoting adhesion in resistance to forward take-off forces; and/or c) a ground engagement section located in an area of the sole extending laterally upwardly around the inner edge of the sole and capable of promoting adhesion and rebound in response ground impacting solicitations from the player in that section.

According to an advantageous aspect for the provision of sculpted patterns in at least one of the sections of the sole, recesses are provided in the form of groups or rows of cells in the solid areas of the said section, each cell opening through an aperture defined by a closed line, elongated in a specified direction and having ends without sharp corners.

By suitably specifying the depth and arrangement of these cells in the lower face of the area of the sole in question, it is possible to modulate or adjust the apparent or overall compressibility of the sole, perpendicular to the lower surface thereof, in the solid areas around such cells. This is because, as is known, the rubber (elastomer) forming a solid area cannot generally be compacted in this direction if there is no possibility of expansion in another direction (deformation is only possible by elastic creep). In other words, if the player's foot exerts a high pressure on a rubber solid area in contact with the ground, the material can only absorb or damp part of the applied force by lateral deformation, that is to say by a movement of at least one of the edges of the cell towards its hollow centre portion.

In addition to the absorption of part of the dynamic energy supplied by the player before the pressure is transmitted to the ground, the overall compression of the rubber solid area around the cell is manifested by an increase in the contact surface of this solid area and therefore a decrease in its pressure on the ground. This phenomenon is exploited, according to the invention, to adjust the dynamic pressures generated in the lower face of the sole and equalize their level throughout the ground engagement section concerned, in accordance with data obtained by experience for the type of game and the playing conditions.

Thus, the modulation of the overall compressibility requires a suitable choice of dimensions, including the depth, and of the density of distribution of the cells, in each engagement section and/or between different engagement sections. These factors, which determine the indentation ratio, or percentage of the area occupied by the recesses in the surface of an area, provide a means for the adjustment of the overall or apparent compressibility of each elementary area of the sole.

In one embodiment, the aperture of each cell in the lower face of the said area comprises two substantially straight longitudinal edges, preferably parallel, whose corresponding ends are joined in pairs by a curved line without any angular point.

The walls of these longitudinal edges may be perpendicular to the solid area around the aperture of the cell thereby creating sharp edges useful for the grip of the sole. It is desirable of course to adjust the distribution of sharp edges, in other words the density of sharp edges, which can grip the ground surface transversely to their orientation in the rubber areas.

As regards the arrangement of the cells in the surface, substantially all the cells of a given main engagement section, or for a majority of these may be provided with a common orientation. This is the case, for example, for cells formed in the main engagement sections intended to facilitate sliding in a preferred direction. These parallel cells can be distributed in a staggered arrangement in the engagement section.

Thus these cells make it possible to form different main engagement sections in the sole according to the types of response required by the player, while adjusting the compressibility of each of these areas to limit the maximum local pressure concentrations in each main ground engagement section of the sole in order to make the pressures exerted as uniform as possible therein when subjected to specific solicitations by the player in action. This uniformity of distribution of the pressures provides a better overall adhesion of the sole and a slower and more uniform development of the wear. In this respect also it is advantageous that the indentation ratio resulting from the arrangement of cells in the solid areas be greater in the main ground engagement sliding section than in the main ground engaging gripping sections of the sole.

According to one embodiment, particularly suitable for playing tennis one or more main sliding sections are provided with cells oriented obliquely in a direction lying at an angle in the range from 30° to 45°, preferably from 35° to 40°, and most frequently about 37°, to the longitudinal direction of the shoe.

The invention also relates to a sole made from flexible elastomeric material designed to be fitted to the lower face of a sports shoe.

BRIEF DESCRIPTION OF THE DRAWINGS

To facilitate the understanding of its principal arrangements and of other aspects or variants, a detailed and non-limiting embodiment of the invention for a tennis shoe is described below, with reference to the attached drawings, in which.

DETAILED DESCRIPTION OF THE DRAWINGS

Figure 1:
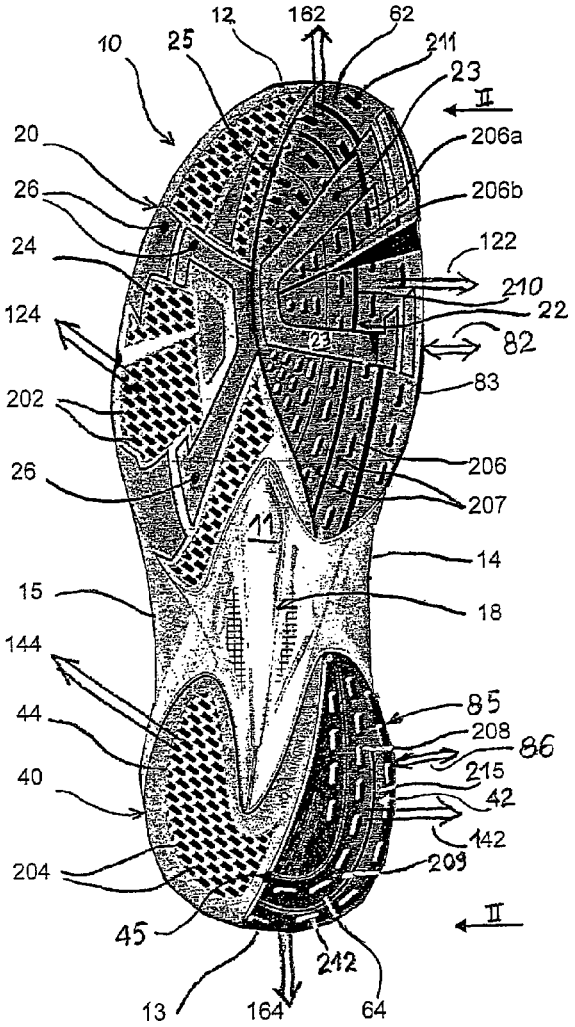
FIG. 1 is a plan view of the lower face of the sole of this shoe.

FIG. 1 shows the lower face 11 of a sole 10 of a tennis shoe made to fit the right foot of a player. It is limited by two ends, front and rear, 12 and 13, at the toe and the heel of the shoe respectively. These ends are connected by two lateral edges, namely an inner edge 14 facing the player's left foot and an outer edge 15, on the other side. A set of sculpted patterns is visible in this face, formed by indentations or recesses in solid rubber areas, either in order to create inscriptions or decorative designs, or to create sharp edges or functional transitions between the solid areas, which are normally in contact with the ground, and recesses, or hollowed areas, which do not touch the ground. The sole is formed by a layer of thick rubber, based on a natural or synthetic elastomer, capable of being deformed elastically, principally by flexion, in response to movements of the foot. In this example, it is formed by moulding, and has an upward extension of rubber at its periphery, clearly visible at 9 on the inner side in FIGS. 2 and 3, which is fixed to the base of an upper or top shell of the shoe (not shown) which is made from reinforced fabric decorated by the addition of supplementary designs or decorative elements. The sole 10 itself is completed inside the shoe by other layers of material for reinforcement, comfort and hygiene, and by an insole intended to support the foot directly.

The view of the lower face 11 of the sole 10 shows that it has a front part and a rear part indicated generally by the arrows 20 and 40 respectively. These two parts are separated by an intermediate part 18 which is shown more fully in FIG. 1 and which corresponds to part of the lower face 11 which has no contact, or only little contact, with the playing surface. The front part 20 is divided into two main engagement areas or sections juxtaposed with each other in the longitudinal direction of the shoe, of which one, 22, called the inner front area or section, is next to the inner lateral edging 14 of the lower face 11, while the other, 24, called the outer front area or section, is next to the outer lateral edge 15 of the lower face 11. These two areas extend between the intermediate part 18 and the toe or front end 12 of the sole. They are separated in the median part by a groove 25 running in a generally longitudinal direction between the toe 12 and the intermediate part 18. (It is worth noting in passing that the example of embodiment illustrated herein has areas of rubber not having any internal design, such as 23, which are flush with the area 22, and 26, which are flush with the area 24. These areas have no technical function in relation to the subject of the present invention).

The main inner front engagement area or section 22 is subject to considerable forces imparted by a tennis player. According to one aspect of the present invention, it is provided with a pattern which gives it a high capacity for grip or adhesion against tangential forces in the lateral direction, particularly ground reaction forces acting in the inward direction, as shown by the arrow 122, or in the outward direction.

To continue with the explanation of this embodiment of the invention, the principal outer front engagement area or section 24 is an area which enables the player to move by sliding in a controlled way in an oblique forward and outward direction as shown by the arrow 124 in FIG. 1.

A main inner engagement area or section 42 next to the inner edge 14 and a main outer engagement area or section 44 next to the outer edge 15 can also be identified in the rear part 40 of the lower face 11 of the sole 10. These two areas extend substantially between the rear end or heel 13 and the intermediate part 18 of the sole, and are separated by a generally longitudinal groove 45. Their respective patterns provide, on the one hand, a high capacity for grip or adhesion in the lateral direction for the area 42, in order to give maximum resistance to the tangential forces of the ground on the sole, particularly in the inward direction indicated by the arrow 142, and, on the other hand, easy controlled sliding for the area 44, in an oblique forward and outward direction (as seen from the rear end 13 of the sole), indicated by the arrow 144 in FIG. 1.

According to the same aspect of the invention, the sole 10 also has a main take-off engagement area or section near the front 62 in the vicinity of the toe 12 of the sole, and a braking area or section for forward movements in the heel, identified by 64, near the end 13. In this case, each of these areas is located in the direct continuation of the respective inner lateral engagement area 22 or 42. It is provided with a sculpted pattern which gives it a high capacity for adhesion in respect of longitudinal forces exerted by the ground on the sole. These forces in reaction to the engagement of the player's foot in the shoe are indicated by the respective longitudinal arrows 162 and 164 in opposite directions.

Figure 2:
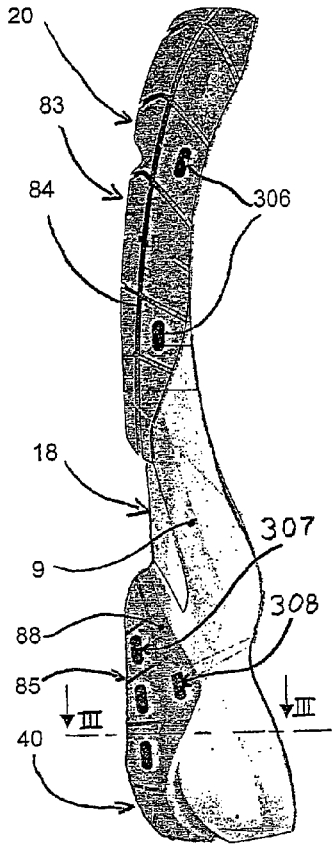
FIG. 2 is a view of the inner lateral profile of the sole taken in the direction of the arrows II-II of FIG. 1.
Figure 3:
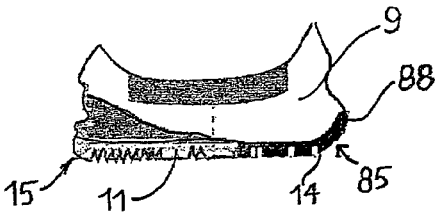
FIG. 3 is a schematic sectional view of the heel of the said sole taken along the line III-III and in the direction of the arrows shown in FIG. 2.

Finally, according to the aforementioned aspect, the sole can also be advantageously provided with two supplementary engagement areas, or rebound areas or sections, namely a front area 83 and a rear area 85, located respectively in the front part 20 and the rear part 40 of the sole 10. These areas are formed overlapping the inner lateral edge 14. As shown in FIG. 2, these areas extend to a certain degree into the upward extension of the rubber 9 along the edge of the sole. They are designed to give the sole a high capacity for rebound in response to the impact of the player's foot in the shoe, as shown by the arrows 82 and 86 respectively (FIG. 1).

The applicants have found that an excellent way of improving both the adhesion and the wear-resistance of a sole subject to very high loadings and intensive use, as in the case of tennis shoes for top-level players, is to eliminate, or to decrease as much as possible differences in the pressures or the levels of stress applied across at least one ground engagement section of the sole in reaction to a corresponding specific type of efforts applied by, or of solicitations from the player's foot in the different phases of the game. To achieve this it has been found that the vertical compressibility (overall or apparent) of the sole can be modulated throughout the ground engagement section of its lower face concerned. In one embodiment, the sole compressibility in the section concerned is adjusted by a suitable arrangement of the sculpted patterns. In other words, as explained in more detail later on, the recesses and solid areas at each location in the ground engagement section concerned are distributed to obtain a relatively uniform pressure throughout that section when subjected to a respective specific mode of solicitation, e.g. ground compression impact or tangential sliding push by the player. Even more specifically, the distribution of the solid areas and the recesses is such that the rubber of the solid areas in the sole when pressed downwards by dynamic force components is allowed to creep laterally into the recesses formed in the surface of this sole. The greater or lesser amount of lateral creep depends on the indentation ratio at each location within the sole section concerned and determines the amplitude of the deformation of the sole by compression locally.

Figure 5A:
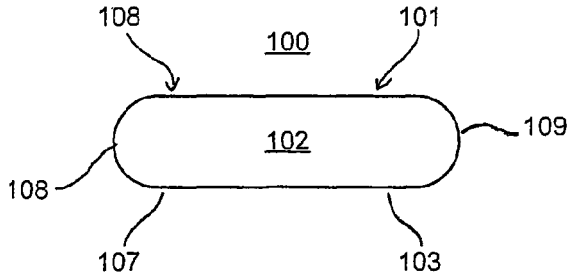
FIG. 5*a* shows a preferred technical solution in relation to the aforementioned embodiment.

In a preferred embodiment (FIG. 5*a*), the recesses are made in the form of cells 102 created in the solid areas, each of these cells opening on the lower face of the sole through an aperture whose edges form a closed line, elongated in one specified direction, and having ends without sharp corners. FIG. 5*a* shows a plan view of an aperture 101 through which the cavity of a cell 102 created in the rubber of a solid area 100 opens on the lower face of the sole. The profile of this aperture 101 is a closed line 103 elongated in a preferred direction defined by its two parallel longer straight edges 106 and 107, whose corresponding ends are connected by two curved edges 108 and 109 without any angular point or profile at the junction with the elongate straight edges 106 and 107. The hollow in the rubber which forms the cavity is itself free from sharp corners. This sculpted design allows for a fine modulation of the indentation ratio of the rubber of the sole, in terms of the percentage of voids in an area of rubber in which the solid areas are in contact with the ground to which they transmit their forces. It not only allows to achieve the adequate adjustment of the ratio of indentation, but also the desired positioning and density of distribution of the sharp rubber edges which form the straight edges 106 and 107 of the cells 102 and achieve or reinforce the grip of the sole in the playing surface in response to the forces imparted by the player to the shoe.

As explained above, when a solid rubber area is subjected to a vertical compressive force, it can be compacted to a certain degree in the direction of the thickness of the sole, because the rubber is able to creep elastically laterally of that direction into the void provided by an adjacent cell. Thus, even if the rubber material from which the solid areas are made is itself incompressible, any given section of the sole can be provided with a degree of compressibility, called the overall or apparent compressibility, thanks to the lateral rubber expansion capability provided by the cells adjacent to the solid areas.

Figure 5B:
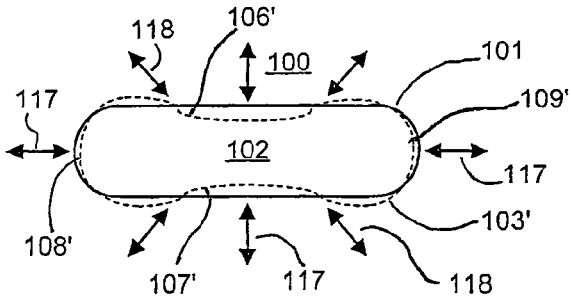
FIG. 5*b* shows the operation of this solution in the conditions in which the invention is used.

FIG. 5*b* shows the deformation of the walls of the cell 102 of FIG. 5*a* when the solid rubber area 100 indented by this cell is subjected to a high pressure by the high powered engagement of a player's foot with the ground. It has been found that the mouth of the aperture takes the form of the broken line 103' as a result of the tendency of the rubber to creep laterally. The straight edges 106 and 107 advance towards the inside of the cavity 102 as far as the positions 106' and 107'. Similarly, the rounded end edges 108 and 109 tend to be flattened into the positions 108' and 109'. The overall effect is manifested by a reduction of the area of the aperture 103 and a corresponding increase in the ground contact surface of the surrounding solid area 100. One can understand that the more lateral expansion capability is provided by hollowed areas in the immediate vicinity of solid areas subjected to heavy compression stresses perpendicular to the ground, the better the possibility for the rubber of these solid areas to flow easily into the cavities of cells nearby. Accordingly, the greater the ratio of indentation the greater will be in general the apparent compressibility of the shoe section concerned.

Figure 4:
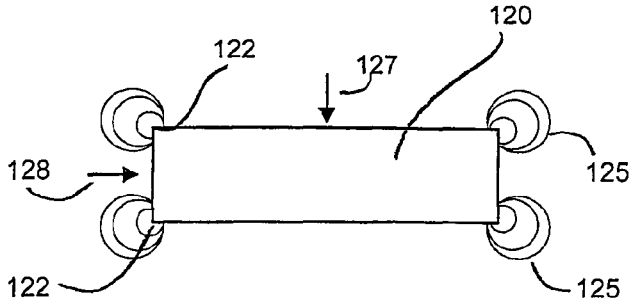
FIG. 4 shows a possible embodiment of a recess in a solid area of the sole.

Because of the absence of any angular point in the wall of the cavity 102, the internal stresses in the rubber bordering on the aperture 101 are distributed in a relatively uniform way when the rubber is pushed laterally towards the inside of the cavity 102, as shown by the arrows 117 and 118. This would not be the case if the aperture delimiting the cell had the rectangular shape shown at 120 in FIG. 4. This is because, in this case, concentrations of stresses would appear at the vertices 122 of the four right angles of the rectangular profile, as shown by the lines of equal stress 125, when the rubber is pushed towards the inside of the cell (arrows 127 and 128). These concentrations increase the fatigue of the rubber until it is ruptured as a result of premature cracking around the cell. Consequently, not only is it advantageous to make the recesses according to the invention in the form of elongated cells with a closed profile because of their flexibility of use, but it is also preferable to provide them with a profile having no angular areas.

Figure 6:
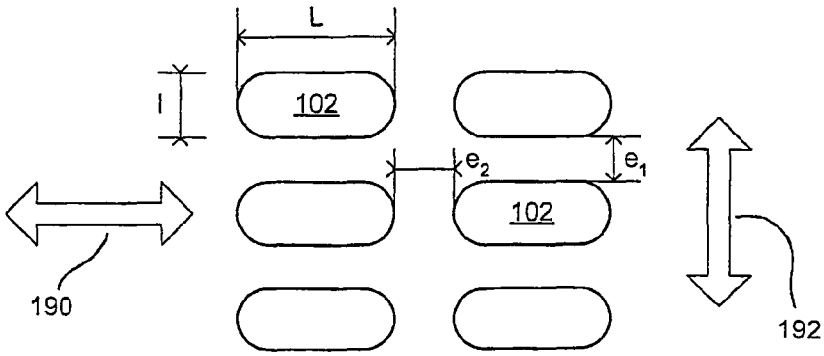
FIG. 6 illustrates the explanations of the method of arrangement of the sculpted elements of the sole for the application of the invention.

FIG. 6 shows schematically six cells 102 having a width 1 and a length L, aligned in three rows and two columns. The way in which the cells are designed and associated with each other enables a controlled compromise to be achieved between the following performance characteristics: the slip, grip, and engagement pressure, in accordance with the main ground engagement areas or functional sole sections identified previously. In the areas, or sections, which are to permit sliding movements, the cells are oriented in the preferred direction of sliding indicated by the arrow 190. As the width 1 decreases, sliding becomes easier. An increase in the length L improves the grip of the sole in opposition to the tangential forces applied in reaction by the ground in the direction of the perpendicular arrow 192. Finally, the dimensions of the intervals e1 between the cells in a single column and e2 between adjacent cells of a row determine the indentation ratio, in other words the percentage of the surface area of the recesses in a given section of the lower surface of the sole, in view of the fact that this indentation ratio has a significant effect on the apparent compressibility of the sole and on the attempt to make the pressure on the ground uniform, as explained previously.

Thus, with reference to FIG. 1 again, the outer lateral engagement areas 24 and 44 are provided with cells 202 and 204 which are elongated in the direction of the arrows 124 and 144 and are inclined forwards and outwards at an angle of 37° with respect to the longitudinal direction of the shoe. It has been found that, to achieve correct operation of the invention in the case of tennis shoes, this inclination must advantageously be in the range from 30° to 45°, and preferably from 35° to 40°.

In the main areas promoting sliding, the longitudinal sharp edges of the cells have a function of providing a degree of guidance to the sliding movements parallel to their length. If an excessively marked rail effect in sliding is to be avoided, the length of the cells 24 and 44 must preferably be decreased with respect to the desirable length of the cells such as 206 and 208 which are intended for the inner lateral areas 22 and 42. This is because the last-mentioned cells have the function of providing maximum grip, transversely of their length, in resistance to the tangential forces applied by the ground to the shoe in reaction to the solicitations of the shoe sole by the player for changing direction or striking the ball. FIG. 1 shows that most of the cells 206 and 208 are relatively more elongated than the cells 202 of the sliding areas (between 3 and 5 times their width in this case) and are positioned in a generally longitudinal direction to provide good lateral grip or resistance to lateral slipping.

At least some of the cells 206 and 208 are arranged as rows formed in rubber strips having a generally longitudinal direction, such as 207 and 209, which are separated from each other by continuous longitudinal grooves, such as clearly shown at 210 and 215 in FIG. 1, between the intermediate part 18 and the front or rear of the sole for the strips 207 and 209 respectively. The longitudinal sharp edges of these grooves contribute to the grip of the areas 22 and 42 in which they are formed. The lengths of the cells 206 decrease as a function of their distance from the inner lateral edge 14 of the lower face 11 of the sole 10. Thus the reference 206*a* indicates a cell located in a strip 207 near the lateral edge 14 and 206*b* indicates a cell farther away from the edge 14, located in a strip or area of rubber in the front lateral area 24 near the groove 25 which separates this engagement area from the outer lateral area 24. The cell 206*b* is substantially shorter than the cell 206*a*.

The cells 206 and 208 are aligned in rows or succession along lines parallel to the path of the grooves such as 210, separating the adjacent front strips 207, and grooves such as 215, separating the adjacent strips such as 209. Towards the front of the face 11, the path of the strips 207 continues to follow the profile of the inner lateral edge 14, exhibiting a progressive change of direction, eventually becoming substantially perpendicular to the central groove 25 separating the outer and inner lateral areas. This forms what has been described above as the take-off section or area. Inside this area, cells 211 have an orientation perpendicular to the longitudinal direction. Similarly, at least one of the strips 209 of the rear inner lateral engagement area 42 extends and changes its orientation progressively, to follow the profile of the inner lateral edge 14, until it forms, in the vicinity of the rear end 13, the braking area 64 provided with cells 212 oriented perpendicularly to the longitudinal direction of the shoe.

As is also shown clearly in FIG. 1, the areas provided with cells in the front and rear outer main ground engagement areas or sections 24 and 44 have no continuous groove. The staggered distribution of the relatively short cells 202 and 204 provided in these sections is very dense relative to the density of cells in the inner lateral areas 22 and 42. It only leaves thin solid areas of rubber between the cells to provide contact with the playing surface. The solid areas in these sections occupy a substantially smaller portion of the engagement sections 24 and 44 in the lower face 11 of the sole than do the recesses which open through apertures 101 in these sections. In contrast, the ratio of indentation in the ground impacting sections 22 and 42 is substantially smaller than that of sections 24 and 44. It leaves a proportionally greater total solid area of contact with the ground in these zones to withstand the dynamic pressures undergone in play.

The rebound section 83 covers the inner lateral edging 14 at the front of the sole 10 along a good part of its length between the intermediate part 18 and the toe of the sole. It adjoins, on one side, the innermost longitudinal rubber strip 207, and extends at 84 into the upward extension of the rubber 9 (FIG. 2). The lateral edging 14 has a well rounded profile along the whole length of this rebound area 83. The upward extension 84 is provided with at least one line of cells 306 which are oriented in the longitudinal direction of the shoe and which impart to the said area sufficient compressibility to give the player a rebound impulse when he bears down sharply on the sole at the limit of the edging 14. Similarly, the rear rebound area 85 is formed on the edging of the rubber strip 209 and covers the edging 14 whose rounded profile is clearly shown in FIG. 3. It extends at 88 into the upward extension of the rubber 9 where it is provided, in this example, with a first row of three cells 307 which are oriented in the longitudinal direction and with a supplementary cell 308 above this row, to impart to the area 85 a high rebound capacity in response to the re-engagement impulses exerted by the heel of the player on the edging of the sole.

In an example for an embodiment described herein, the cells of the sliding areas or sections 24 and 44 are all identical, with a depth of about 3 millimeters, a length of 4 millimeters and a width of approximately 1.5 millimeters. They are distributed in a staggered arrangement with distances of about 1 millimeter between the lines and 1 millimeter between the adjacent ends of the aligned cells. The width of the cells of the ground engagement gripping sections or areas 22 and 42 is about 2 millimeters, and their length can vary from 5 to 10 millimeters, depending on the location. Trials conducted by competitive tennis players with shoes made according to the principles described above have yielded remarkable results. The overall performance was improved and maintained for a number of hours of use which was substantially more than twice the best standard available at present for this level of the sport and its requirements.

The invention claimed is:

1. A sports shoe comprising:

an upper for encasing a foot of a player; and a sole made from a flexible, elastically deformable material, the sole having a front end, a rear end, and a periphery fixed to the upper;

the sole having a lower face for contacting, at least in part, the ground during use, the lower face defining an inner lateral edge corresponding to an inner portion of a foot, an outer lateral edge corresponding to an outer portion of the foot, front part including the front end, a rear part including the rear end, and an intermediate part between the front and rear parts;

the front part defining an inner front engagement area adjacent to the inner lateral edge and an outer front engagement area adjacent to the outer lateral edge, the inner front engagement area and the outer front engagement area being at least partially adjacent to each other and being separated by a first longitudinally extending groove;

the rear part defining an inner rear engagement area adjacent to the inner lateral edge and an outer rear engagement area adjacent to the outer lateral edge, the inner rear engagement area and the outer rear engagement areas being at least partially adjacent to each other and being separated by a second longitudinally extending groove; and the inner front and outer front engagement areas, and/or the inner rear and outer rear engagement areas, defining a plurality of recesses and solid areas across a surface of the respective areas, the recesses being in the form of elongated cells defined in the solid areas, the elongated cells opening on the lower face of the sole through an aperture having two edge portions having corresponding ends connected by two curved edge portions;

wherein a ratio of indentation between the recesses and solid areas in the inner front engagement area is less than the ratio of indentation between the recesses and solid areas in the outer front engagement area, and/or a ratio of indentation between the recesses and solid areas in the inner rear engagement area is less than the ratio of indentation between the recesses and solid areas in the outer rear engagement area, respectively.

2. The sports shoe of claim 1, wherein the two edge portions are two straight edge portions having corresponding ends connected by the two curved edge portions.

3. The sports shoe of claim 2, wherein the two straight edge portions are parallel.

4. The sports shoe of claim 1, wherein a plurality of the cells of a respective engagement area have a common orientation.

5. The sports shoe of claim 4, wherein all of the elongated cells of a respective engagement area have a common orientation.

6. The sports shoe of claim 1, wherein the walls of the straight edge portions are perpendicular to the solid area around the aperture of the cell thereby creating sharp edges with respect to the solid area.

7. The sports shoe of claim 6, wherein the distribution of sharp edges is provided such that the edges are adapted to grip the ground surface transversely to their orientation in the lower sole.

8. The sports shoe of claim 1, wherein the outer front engagement area and the outer rear engagement area are provided with cells inclined forward and outward at an angle between 30° to 45° with respect to a longitudinal direction of the shoe.

9. The sports shoe of claim 8, wherein the angle is between 35° to 40°.

10. The sports shoe of claim 9, wherein the angle is 37°.

11. The sports shoe of claim 2, wherein junctions between the two straight edge portions and the curved edge portions are smooth.

12. The sports shoe of claim 1, wherein the flexible, elastically deformable material comprises rubber.

13. The sports shoe of claim 12, wherein the hollow in the rubber.

14. The sports shoe of claim 1, wherein:

the inner front and outer front engagement areas and the inner rear and outer rear engagement areas each define a plurality of recesses and solid areas across a surface of the respective areas;

the ratio of indentation in the inner front rear engagement areas is substantially less than the ratio of indentation in the outer front engagement area; and the ratio of indentation in the inner rear engagement areas is substantially less than the ratio of indentation in the outer rear engagement area.

15. The sports shoe of claim 1, wherein a ratio of indentation in the inner front engagement area is substantially less than the ratio of indentation in the outer front engagement area, and/or the ratio of indentation in the inner rear engagement area is substantially less than the ratio of indentation in the outer rear engagement area, respectively.

* * * * *